United States Patent [19]

Fritschen et al.

[11] Patent Number: 4,720,279

[45] Date of Patent: Jan. 19, 1988

[54] HOOK WATER SPORTS HAND GRIP

[76] Inventors: Charles L. Fritschen; Elizabeth A. Fritschen, both of 17062 - 66th Pl., NE., Bothell, Wash. 98011

[21] Appl. No.: 14,658

[22] Filed: Feb. 13, 1987

Related U.S. Application Data

[63] Continuation-in-part of Ser. No. 752,798, Jul. 8, 1985, abandoned.

[51] Int. Cl.[4] ..... A63C 15/06

[52] U.S. Cl. ..... 441/69; 2/161 A

[58] Field of Search ..... 441/68, 69; 114/39.2; 2/17, 161 A; 272/67, 68, 119, 123; 294/15, 25, 26

[56] References Cited

U.S. PATENT DOCUMENTS

| | | | |
|---|---|---|---|
| 3,541,990 | 11/1970 | Du Mas | 441/69 |
| 4,000,903 | 1/1977 | Swanson | 2/161 A X |
| 4,081,864 | 4/1978 | Liman | 2/161 A |
| 4,235,182 | 11/1980 | Burger | 441/69 X |
| 4,329,741 | 5/1982 | Bach | 2/161 A |
| 4,400,831 | 8/1983 | Rietz | 2/161 A |
| 4,438,532 | 3/1984 | Campanella et al. | 2/161 A X |
| 4,484,740 | 11/1984 | Green | 272/119 |

FOREIGN PATENT DOCUMENTS

| | | | |
|---|---|---|---|
| 2514721 | 10/1981 | France | 441/69 |

OTHER PUBLICATIONS

*Iron Man,* "Conway Lat Straps", Advertisement, Jul. 1983, p. 61.

*Primary Examiner*—Joseph F. Peters, Jr.
*Assistant Examiner*—Paul E. Salmon
*Attorney, Agent, or Firm*—Klarquist, Sparkman, Campbell, Leigh & Whinston

[57] ABSTRACT

A device is disclosed to assist a wearer in firmly gripping the handle(s) of water sports equipment for long periods of time with minimal hand and arm fatigue. The device comprises a grip strap of webbing material, a protuberant rib which extends transversely of the strap, at least one finger-attaching member near the rib at one end of the grip strap, and a wrist strap and fastening means attached to the other end and on the reverse side of the grip strap. The grip is constructed such that when, in use, a wearer's fingers are extended, the palm strap becomes taut between the finger attachment member and the wrist strap such that the wearer's retained fingers are supported in a hooked position. And, when the wearer's hand is curled around a handle, the rib can extend beyond the wearer's fingertips.

20 Claims, 11 Drawing Figures

FIG. 7
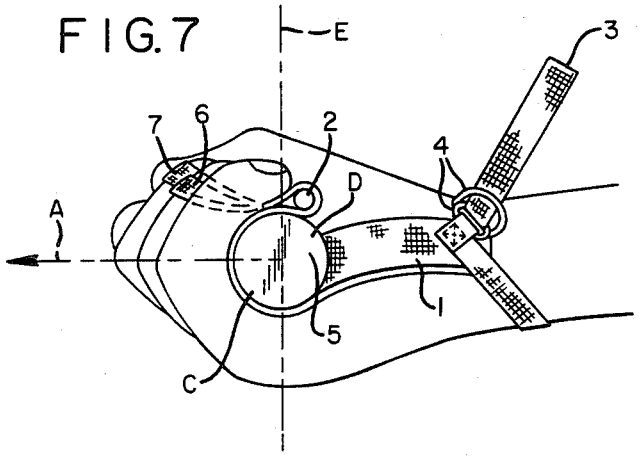
FIG. 6
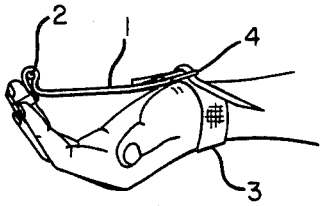
FIG. 8
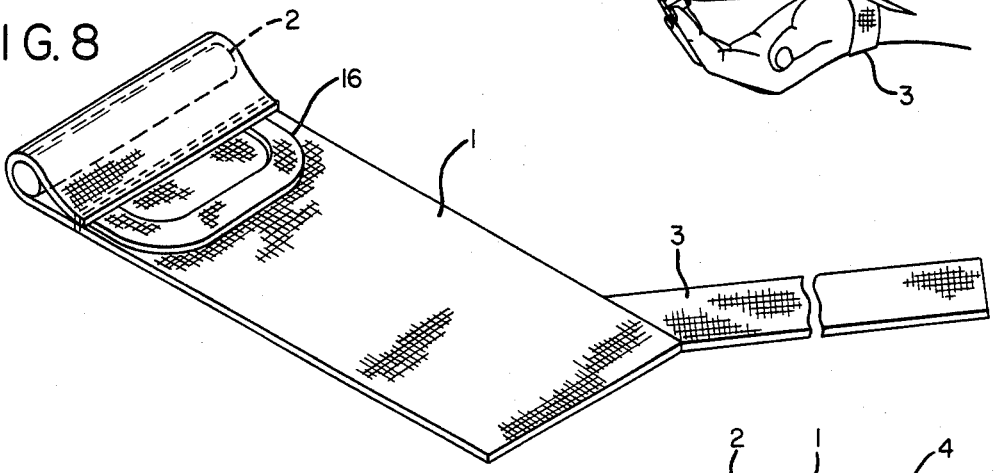
FIG. 9
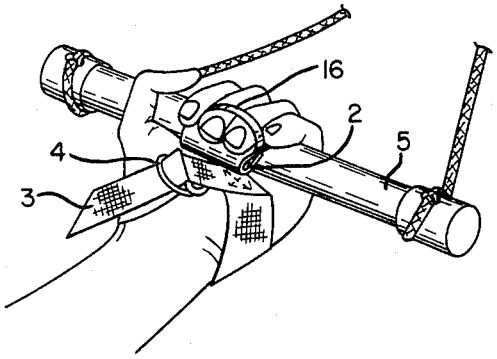
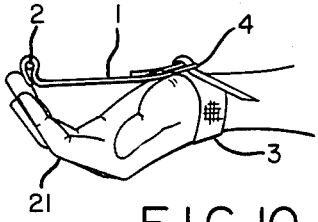
FIG. 10
FIG. 11
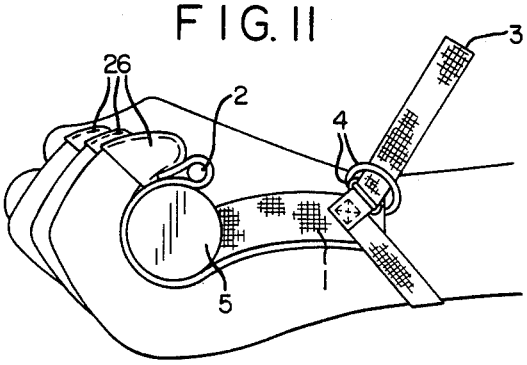

HOOK WATER SPORTS HAND GRIP

This is a continuation-in-part of application Ser. No. 752,798, filed July 8, 1985, abandoned.

BACKGROUND OF THE INVENTION

This invention relates to a device for firmly gripping water ski tow rope cross bars, wind surfer booms, etc., for long periods of time without hand fatigue.

Previously available hand grips for water sports are non-slip gloves. Most such grips do little or nothing to relieve tension on the wearer's hand. Some such grips actually increase hand and arm fatigue. One of the best of such prior grips is shown in U.S. Pat. No. 4,400,831.

SUMMARY OF THE INVENTION

The present invention is a hand grip, designed for use in or out of water, which greatly increases the wearer's overall gripping strength and endurance. The grip includes a grip strap made of webbing which may have a non-slip material on one surface. A protuberant rib is provided by a dowel enclosed at one end of the strap. One or more finger attachment members, such as finger loops, are disposed on one side of the strap to secure the strap to the user's fingers and thus keep the grip strap in position on the user's hand. On the reverse side of the strap at the end opposite to the dowel, is fastened a wrist strap and two cinch rings mounted in a fashion to provide maximum comfort for the user.

In use, a wearer's fingers are inserted into the finger attachment members and the wrist strap is wrapped around the wrist, passed through the cinch rings, and tightened. When so attached, the grip prevents the user from fully extending the fingers secured to the grip. When a tow rope cross bar or other cylindrical object is gripped, the grip strap is partly wrapped around the cross bar, and minimal pressure by the fingers on the dowel provides leverage to press the grip strap firmly against the cross bar. The wrist strap wrapped around the wrist transfers the tension of the tow rope to the arm, relieving muscular tension in the hand and arm and eliminating hand and arm fatigue, while providing a much stronger overall grip.

BRIEF DESCRIPTION OF THE DRAWINGS

FIG. 6 is a perspective view of the grip of FIGS. 1–3 with the wearer's secured fingers extended as far as allowed by the grip;

FIG. 7 is a perspective view of the grip of FIGS. 1–3 showing a force vector;

FIG. 8 is a perspective view of a third embodiment of a hook water sports hand grip in accordance with the invention;

FIG. 9 is a perspective view of the grip of FIG. 8 as it would be used;

FIG. 10 is a perspective view of a fourth embodiment of a hook water sports hand grip in accordance with the invention; and FIG. 11 is a perspective view of a fifth embodiment of a hook water sports hand grip in accordance with the invention.

DETAILED DESCRIPTION

Figure 1:
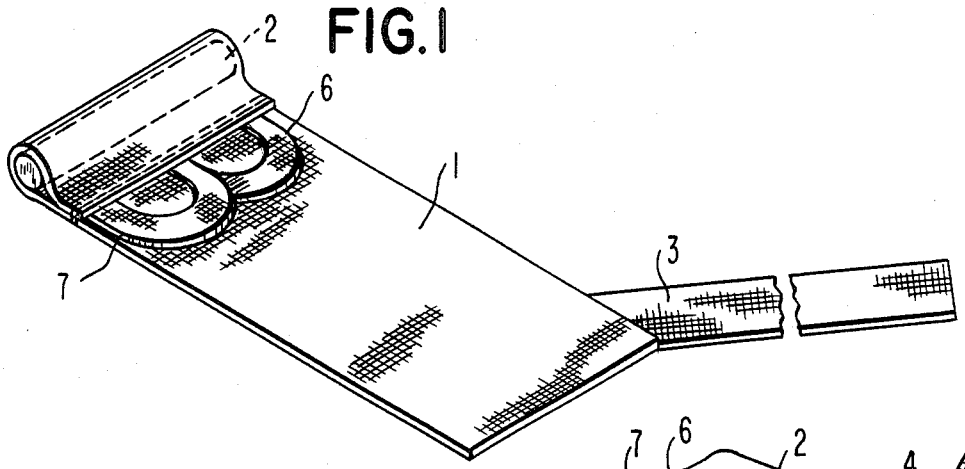
FIG. 1 is a top perspective view showing the palm side of a hook water sports hand grip in accordance with the invention.

Referring now to the drawings, there is shown in FIG. 1 a palm or grip strap 1 which may be made with a non-slip surface to enhance friction with an object to be grasped. The strap 1 has a finger end and a wrist end. At the finger end, the strap 1 encircles a dowel 2 and is folded back to itself and sewn to provide a protuberant rib which extends transversely to the strap 1. The grip is constructed to be secured at two locations in relation to the wearer's hand, near the distal end of at least one finger and at the wrist.

Figure 3:
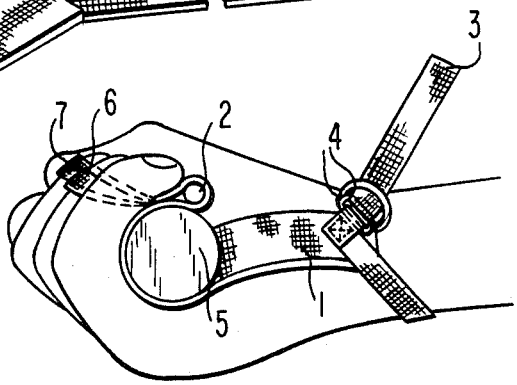
FIG. 3 is a perspective view of the grip of FIG. 1 as it would be used.

In FIG. 1, two finger loops 6 and 7 are narrow strips of material sewn at each end onto the strap 1 next to the dowel on the side of the strap that is in contact with the wearer's palm when in use. The loops are used to secure the strap 1 to two of the wearer's fingers and limit the distance the rib can move along the fingers toward the wearer's wrist. The illustrated loops are made of strips of such a size and shape that when the grip is in use, each loop surrounds only a small area of each finger received by the loop so that other portions of the finger are open to the air. A common threadline secures both the finger loops 6, 7 and the loop of the grip strap 1 which encircles the dowel 2. As shown by FIG. 3, the finger loops are on the middle and ring fingers of the wearer when in use. Any two fingers could be used, however, depending on the user's preference.

Figure 2:
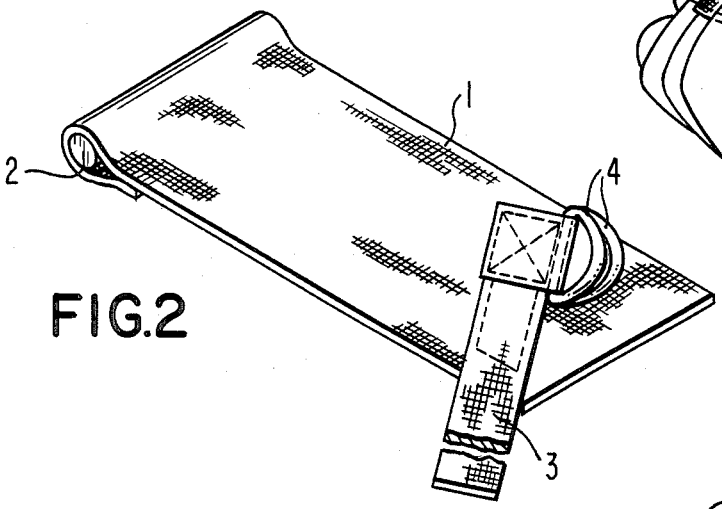
FIG. 2 is a bottom perspective view of the grip of FIG. 1 showing the outer side of the grip.

As shown in FIG. 2, at the wrist end of the strap opposite the dowel, there is attached a wrist strap 3 for securing the grip at the wearer's wrist. The wrist strap extends outwardly from the wrist end of the palm strap 1 at an acute angle, 45° in the illustrated embodiments, to the palm strap 1. Two cinch loops 4 are provided near the point of attachment of the wrist strap 3 to the grip strap 1.

The grip strap 1 and loops 6, 7 have been laid out such that two of the user's fingers can be inserted into the loops 6, 7, with the loops positioned between the fingertips and the second joints up from the fingertips with one segment of each inserted finger wedgingly engaging a loop. The strap 1 is secured at the wrist end by wrapping the wrist strap 3 around the wrist at a location inwardly of the metacarpals, passing the wrist strap through the two cinch rings, and then tightening. The wrist strap should not be cinched so tightly around the wrist as to cut off circulation. It need only be cinched to a sufficiently small diameter that it cannot slide past the widened portion of the hand where the thumb protrudes.

The grip is configured such that a wearer's inserted fingers are prevented from being fully extended. As shown in FIG. 6, before fingers received by the loops 6, 7 can be fully extended, the strap 1 becomes taut between the rib and the wrist strap because the length of the strap is less than the length of the wearer's hand between the locations where the grip is attached. The wearer's fingers are therefore supported in the shape of a "hook". Because the fingers are so supported, the user tends to retain a grip on the bar 5 even when the fingers are inadvertently opened. However, if the user forcefully opens his fingers, the grip will release as, to a limited extent, the loops slide along the fingers toward the wrist.

The grip is also sufficiently long such that when the wearer's fingers are curled around a bar 5 (not part of the invention), the grip strap 1 conforms to the circumference of the palm side of the wearer's hand and the fingers lie immediately alongside the bar with the outer surface of the grip strap in contact with the bar. With the wearer's fingers so curled, at least a portion of the protuberant rib can extend beyond the user's fingertips, as shown in FIGS. 3 and 7.

As best seen in FIG. 7, the crossbar 5 has two hemicylindrical halves C, D, defined by a diameter E extending through the crossbar 5 normal to the pulling force in the direction A. The first hemicylindrical half C is disposed in the direction of the pulling force for bearing against a wearer's fingers when the wear grasps the crossbar 5. The second hemicylindrical half D is disposed away from the direction of the pulling force A. It will be appreciated that the hand grip enables the wearer to establish, by grasping the cylindrical crossbar 5, a structural bypass that bypasses the wearer's muscles from the pulling force and directly transfers the pulling force from the bar 5 to the user's arms.

When the user's fingers are curled around the bar 5, as shown in FIG. 7, the palm strap 1 extends entirely around the first hemicylindrical half C of the bar 5 which bears against the wearer's fingers, and the rib formed by dowel 2 bears against the crossbar 5 in the second hemicylindrical half D.

Figure 5:
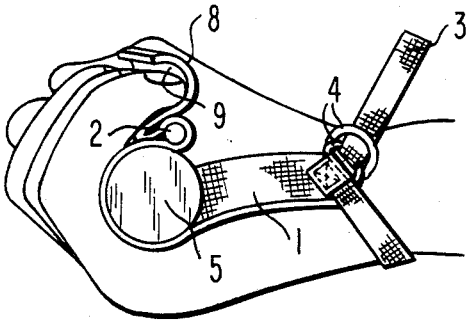
FIG. 5 is a perspective view of the grip of FIG. 4 as it would be used.
Figure 4:
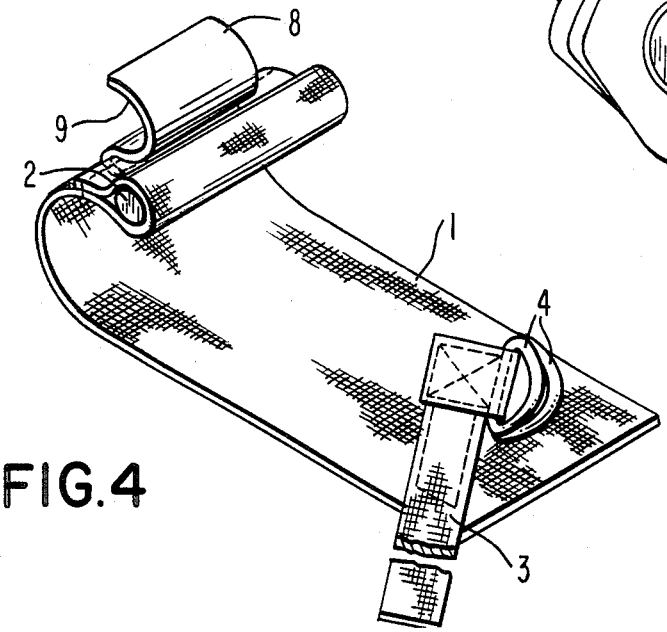
FIG. 4 is a perspective view of a second embodiment of a hook water sports hand grip in accordance with the invention.

A second embodiment of the present invention is illustrated by FIGS. 4 and 5. In this embodiment, the grip has a fingertip-receiving member consisting of a curved open channel 8, in place of the finger loops. The inner surface of the channel 8 is an abutment surface against which a user's finger presses so that the rib is stopped from moving along the finger toward the user's wrist.

A third embodiment is shown in FIGS. 8 and 9. This embodiment is identical to the apparatus of FIGS. 1–3, except there is a single loop 16 of sufficient size to receive two or more of the user's fingers.

A fourth embodiment is shown in FIG. 10. This embodiment is similar to others previously explained, except the grip strap 1 is secured to a glove 21. Either the wrist strap end or finger end can be sewn or otherwise attached to the glove. If the finger end of strap 1 is free, then some other device, such as the loops of FIGS. 1–3, are provided to secure the strap 1 near the distal ends of the fingers.

FIG. 11 shows a fifth embodiment in which the user's fingers are secured to the grip strap 1 by means of a plurality of finger cups or thimbles 26 which are secured to the grip strap 1 by sewing or adhesive. The device of FIG. 1 is similar to that of FIG. 5 in that it includes a structure to receiver the user's fingertips and an abutment surface to prevent the palm strap from sliding away from the fingertips. When fingers are inserted in the cups 26, the rib is prevented from moving along the user's fingers toward the wrist.

While several embodiments have been discussed herein, it should be appreciated that various other changes may be made in details of construction, without departing from the spirit and scope of the present invention. For example, finger loops could be made of an elastic material or could be secured by Velcro material to provide a particularly snug grip on the fingers. Also, the rib need not be formed with the dowel 2, but could instead comprise a sewn roll of the grip strap webbing. The roll of webbing could be coated with a moldable plastic material, such as polypropylene, to rigidify the rib. The appended claims are to cover all such changes and modifications as follow in the true spirit and scope of the invention.

We claim:

1. A water sport hand grip for grasping a generally cylindrical object which exerts a pulling force on a user, comprising:

an elongated palm strap for extending longitudinally of a user's hand on the palm side of the user's hand, the strap having a finger end and a wrist end;

a protuberant rib secured to the palm strap adjacent the finger end and extending transversely of the palm strap;

at least one finger loop, each loop comprising a narrow strip of material which is secured at each end to the palm strap adjacent the protuberant rib for slidably and adjustably securing the palm strap to at least one of the user's fingers, each strip being of such a size and shape that when the grip is in use, each loop surrounds only a small area of each finger received by the loop so that other portions of the finger are open to the air; and wrist attachment means extending outwardly from the wrist end of the palm strap for securing the palm strap to a user's wrist.

2. The water sport hand grip of claim 1 wherein the protuberant rib comprises a dowel at the finger end of the palm strap, the palm strap encircling the dowel and being folded back to itself, the palm strap being sewn to itself along at least one thread line for securing the dowel to the palm strap adjacent the finger end, and the one thread line extending through portions of the one finger loop for securing the same to the palm strap.

3. The water sport hand grip of claim 1 wherein the wrist attachment means comprises a wrist strap.

4. The water sport hand grip of claim 3 wherein the finger loop and wrist strap are sewn to opposite sides of the palm strap.

5. The hand grip according to claim 3 wherein the wrist strap extends outwardly from the wrist end of the palm strap at an acute angle to the palm strap.

6. The water sport hand grip of claim 5 wherein the wrist strap is sewn to the wrist end of the palm strap and includes two cinch rings for securing the wrist strap about a user's wrist and to the palm strap.

7. The water sport hand grip of claim 1 wherein:

the protuberant rib comprises a dowel;

the wrist attachment means comprises a wrist strap sewn to the palm strap, the wrist strap extends outwardly from the wrist end of the palm strap at an acute angle to the palm strap and to a location beyond the wrist end of the palm strap;

the finger loop and wrist strap are sewn to opposite sides of the palm strap; and two cinch rings are attached to the palm strap for securing the wrist strap about a user's wrist.

8. A water sport hand grip for grasping a generally cylindrical object which exerts a pulling force on a user, comprising:

an elongated palm strap for extending longitudinally of a user's hand on the palm side of the user's hand, the strap having a finger end and a wrist end;

a protuberant rib secured to the palm strap adjacent the finger end and extending transversely of the palm strap;

at least one fingertip-receiving means secured to the palm strap adjacent the protuberant rib for securing the palm strap to at least one of the user's fingers, the fingertip-receiving means providing an abutment surface such that when the grip is in use, at least one of the user's fingertips presses against the abutment surface so that the rib is stopped from moving along the finger toward the user's wrist, the fingertip receiving means receiving only the end of each finger received so that other portions of the finger are open to the air; and wrist attachment means extending outwardly from the wrist end of the palm strap for securing the palm strap to a user's wrist.

9. The water sport hand grip of claim 8 wherein the fingertip-receiving means comprises a curved open channel.

10. The water sport hand grip of claim 8 wherein the fingertip-receiving means comprises at least one finger cup attached to the palm strap.

11. A water sport hand grip for grasping a generally cylindrical object which exerts a pulling force on a user, comprising:

an elongated palm strap adapted to extend longitudinally of a user's hand on the palm side of the user's hand, the palm strap having a finger end and a wrist end;

a protuberant rib secured to the palm strap adjacent the finger end and extending transversely of the palm strap;

finger attachment means for securing the palm strap at a location near the distal end of at least one of the user's fingers and for stopping the rib from moving along the finger toward the user's wrist; and wrist attachment means for securing the palm strap at the user's wrist;

the palm strap being of such a length that, when the grip is in use with the palm strap secured to the user's hand by the finger attachment means and by the wrist attachment means, (a) tautness of the palm strap between the finger attachment means and the wrist attachment means prevents the user from fully extending the finger, but (b) the user's fingers can be curled around and grasp a cylindrical object.

12. The water sport hand grip of claim 11 wherein:

the protuberant rib comprises a dowel;

the finger attachment means comprises at least one finger loop for slidably and adjustably securing the palm strap to at least one finger, the position of the dowel being adjustable relative to the end of the one finger by the amount the one finger is slid through the one finger loop; and at least a portion of the dowel extends beyond the user's fingertips when the user's fingers are curled around the cylindrical object while grasping the cylindrical object, the one finger loop being positioned between the tip of the one finger and the second joint from the tip of the one finger.

13. The water sport hand grip of claim 11 wherein the finger attachment means comprises a finger loop for slidably and adjustably securing the strap to at least two fingers.

14. The water sport hand grip of claim 11 wherein the finger attachment means comprises two loops for slidably and adjustably securing the strap to two fingers.

15. The water sport hand grip of claim 11 wherein the wrist attachment means comprises:

a wrist strap sewn to the wrist end of the palm strap and extending outwardly from and at an acute angle to the palm strap; and cinch means secured to the wrist strap for securing the wrist strap about a user's wrist and to the palm strap.

16. The water sport hand grip of claim 15 for use by a water skier to assist in grasping a generally cylindrical crossbar of a tow rope which exerts a pulling force on the skier, the crossbar having two hemicylindrical halves defined by a diameter extending through the crossbar normal to the pulling force, a first of the hemicylindrical halves being disposed in the direction of the pulling force for bearing against a skier's fingers when the skier grasps the crossbar, a second of the hemicylindrical halves being disposed away from the direction of the pulling force, the hand grip enabling the skier to establish by grasping the cylindrical crossbar a structural by-pass that by-passes the skier's hand muscles from the pulling force and directly transfers the pulling force from the cylindrical object to the skier's arm, wherein the palm strap and wrist strap are of such lengths that, when the palm strap is secured to the wrist by the wrist strap and the skier's fingers curl around the crossbar when grasping the crossbar, (a) the palm strap extends entirely around the first hemicylindrical half of the crossbar which bears against the skier's fingers, and (b) the protuberant rib bears against the crossbar in the second hemicylindrical half.

17. The water sport hand grip of claim 11 wherein the protuberant rib comprises a dowel and the finger attachment means comprises at least one finger loop sized to be entirely retained by one bone of a user's finger for slidably and adjustably securing the palm strap to at least one finger, the position of the dowel being adjustable relative to the end of the one finger by the amount the one finger is slid through the one finger loop.

18. The water sport hand grip of claim 11 wherein:

the protuberant rib comprises a dowel and the finger attachment means comprises at least one finger loop sized to be entirely retained by one segment of a user's finger for slidably and adjustably securing the palm strap to at least one finger, the position of the dowel being adjustable relative to the end of the one finger by the amount the one finger is slid through the one finger loop; and the wrist strap is sewn to the wrist end of the palm strap and extends outwardly from and at an acute angle to the palm strap and includes two cinch rings secured to the wrist strap for securing the wrist strap about a user's wrist and to the palm strap.

19. The water sport hand grip of claim 11 wherein:

the protuberant rib comprises a dowel and the finger attachment means comprises at least one finger loop sized to be entirely retained adjacent to one segment of a user's finger for slidably and adjustably securing the palm strap to at least one finger, the position of the dowel being adjustable relative to the end of the one finger by the amount the one finger is slid through the one finger loop; and the palm strap encircles the dowel and is folded back to itself, the palm strap being sewn to itself along at least one thread line for securing the dowel to the palm strap adjacent the finger end, and the one thread line extending through portions of the one finger loop for securing the same to the palm strap.

20. A method, which can be used in water, for enhancing a user's grasp on a generally cylindrical object which exerts a pulling force on a hand of the user, the method comprising:

inserting the user's finger into a finger attachment means of a sport hand grip having (a) an elongated palm strap adapted to extend longitudinally of the user's hand on the palm side of the user's hand, the palm strap having a finger end and a wrist end, (b) a protuberant rib secured to the palm strap adjacent the finger end and extending transversely of the palm strap, (c) finger attachment means adjacent the finger end for securing the palm strap in a fixed position in relation to a finger of the user's hand, and (d) wrist attachment means extending from the wrist end of the palm strap for securing the palm strap to the user's wrist; and securing the palm strap to the user's wrist so as to prevent the user from fully extending the inserted finger and yet allow the finger to be curled around and lie alongside a cylindrical object with one surface of the palm strap in contact with the object and the other surface of the palm strap conforming to the palm side of the user's hand.

* * * * *